US009476155B2

(12) United States Patent
He et al.

(10) Patent No.: US 9,476,155 B2
(45) Date of Patent: Oct. 25, 2016

(54) ROLLER WASHING MACHINE AND THE WASHING METHOD THEREOF

(75) Inventors: Zhengbao He, Qingdao (CN); Chunfeng Lao, Qingdao (CN)

(73) Assignees: HAIER GROUP CORPORATION, Qingdao, Shandong (CN); HAIER GROUP TECHNIQUE R&D CENTER, Qingdao, Shandong (CN)

( * ) Notice: Subject to any disclaimer, the term of this patent is extended or adjusted under 35 U.S.C. 154(b) by 300 days.

(21) Appl. No.: 14/239,913

(22) PCT Filed: Oct. 28, 2011

(86) PCT No.: PCT/CN2011/081522

§ 371 (c)(1),
(2), (4) Date: Feb. 20, 2014

(87) PCT Pub. No.: WO2013/026233

PCT Pub. Date: Feb. 28, 2013

(65) Prior Publication Data

US 2014/0189961 A1 Jul. 10, 2014

(30) Foreign Application Priority Data

Aug. 22, 2011 (CN) ..... 2011 1 0240882

(51) Int. Cl.

| | |
|---|---|
| ***D06F 37/04*** | (2006.01) |
| ***D06F 37/26*** | (2006.01) |
| ***D06F 35/00*** | (2006.01) |
| *D06F 23/02* | (2006.01) |

(52) U.S. Cl.

CPC ..... *D06F 37/263* (2013.01); *D06F 35/00* (2013.01); *D06F 37/04* (2013.01); *D06F 37/26* (2013.01); *D06F 23/02* (2013.01)

(58) Field of Classification Search

CPC ..... D06F 37/263

See application file for complete search history.

(56) References Cited

U.S. PATENT DOCUMENTS

| | | | |
|---|---|---|---|
| 5,245,722 | A | 9/1993 | Dameron |
| 2012/0011663 | A1 | 1/2012 | Hanau et al. |

FOREIGN PATENT DOCUMENTS

| | | | |
|---|---|---|---|
| CN | 201424587 | Y | 3/2010 |
| CN | 101886321 | A | 11/2010 |
| CN | 102061588 | A | 5/2011 |

(Continued)

OTHER PUBLICATIONS

International Search Report (PCT/ISA/210) mailed on May 31, 2012, by the Chinese Patent Office as the International Searching Authority for International Application No. PCT/CN2011/081505.

*Primary Examiner* — Jason Ko

(74) *Attorney, Agent, or Firm* — Buchanan Ingersoll & Rooney PC

(57) ABSTRACT

A roller washing machine and the washing method thereof, comprises four layers of mutually sleeved washing tubs and a water containing tub, wherein, a first tub, a second tub, a third tub and a fourth tub are arranged from inside to outside sequentially and particles are stored in a space between the second tub and the third tub; a plurality of first openings used for dewatering are arranged on the walls of the second tub and of the third tub, and a second opening allowing the particles to be put in and recycled is arranged on the wall of the second tub. The roller washing machine integrates such functions as clothes washing, separation of clothes and the particles, recycling and storage of the particles, dewatering of the particles, thus realizing 100% put-in and recycling of the particles, simplifying washing procedures and shortening washing time.

16 Claims, 3 Drawing Sheets

(56) References Cited

FOREIGN PATENT DOCUMENTS

| | | | |
|---|---|---|---|
| CN | 102061589 | A | 5/2011 |
| EP | 0 477 052 | A1 | 3/1992 |
| JP | 9-047599 | A | 2/1997 |
| JP | 2011-019963 | A | 2/2011 |
| WO | 2010/094959 | A1 | 8/2010 |
| WO | WO 2010/115683 | A1 | 11/2010 |
| WO | 2011/064581 | A1 | 6/2011 |

ROLLER WASHING MACHINE AND THE WASHING METHOD THEREOF

FIELD OF THE INVENTION

The present invention relates to a roller washing machine, in particular to a roller washing machine using particles for washing, as well as the washing method thereof. The present invention belongs to the field of washing machine technology.

BACKGROUND OF THE INVENTION

In the washing method of a traditional washing machine, the washing medium is water, adding water and detergents into the washing machine for washing; after washing, discharging the sewage from the washing machine via dewatering function, and then adding clean water again for continuing the washing or rinsing process, finally discharging water after the washing is entirely finished. In this method, the water is simply discharged and then clean water is refilled, thus causes a large amount of water consumption. Meanwhile, lots of chemical substances which are harmful to the environment are contained in the washing liquid, and the washing process is time-consuming with large power consumption each time.

To overcome the shortcomings of the aforesaid traditional washing method, in the prior art, some washing machines use an organic solvent as the medium, for example, a dry cleaning machine, in which the organic solvent is recycled; after the completion of one washing process, the organic solvent containing dirt is collected into a container, disposed by filtration and distillation, and then put back into the washing tub to continue the washing process. Due to the high toxicity of the organic solvent and the relatively low safety factor of medium recycling by distillation, it is not suitable for household use.

There is another washing method using air in the prior art, such as $CO_2$. In this method, the medium is required to achieve the phase changes between gas and liquid, that is, medium is used for washing in liquid phase and then recycled in gas phase. The method demands not only a highly airtight structure, but also a high pressure for liquefying gas, which requires a high-pressure installation, so it is of low safety factor and complex process.

To overcome the shortcomings of the aforesaid washing methods, a washing method with the specially-made solid particles as the washing medium is provided, in which the dirt on clothes is adsorbed and then removed through the friction between the solid particles and clothes, so as to achieve the purpose of washing. The washing method can save over 80% water. Moreover, the solid particles as washing medium can be recycled and reused with a long service life, having no need to change, and being safe and environmentally friendly.

The current roller machines widely used usually comprise an inner tub and an outer tub, wherein, the outer tub is an enclosed structure which is provided with a water inlet and a water outlet; a plurality of openings allowing the water to enter the inner tub are arranged on the inner tub wall. During washing, the outer tub is fixed, while the inner tub rotates, where clothes are continuously lifted and dropped, imitating the most primitive washing theory of beating with a rod hammer. As solid particles cannot be separated, recycled and reused in washing machines of this structure, the aforesaid washing method using solid particles as the washing medium cannot be applied.

SUMMARY OF THE INVENTION

It's an object of the present invention to solve the aforesaid problems and shortcomings by providing a roller washing machine that can realize the washing of clothes, separation, recycling and storage of particles.

It's another object of the present invention to provide a washing method using the aforesaid roller washing machine.

To achieve the aforesaid objects, the technical scheme of the present invention comprises:

A roller washing machine, comprises four layers of mutually sleeved washing tub and water containing tub, wherein, a first tub, a second tub, a third tub and a fourth tub are arranged from inside to outside sequentially, and particles are stored in a space between the second tub and the third tub; a plurality of first openings for dewatering are arranged on the walls of the second tub and the third tub, and a second opening for feeding and recycling the particles is arranged on the wall of the second tub.

Furthermore, the first tub is a net structure of the third openings formed by intersecting warps and wefts for allowing the particles to pass through.

Furthermore, a diameter of the first opening is 1-1.5 mm. Furthermore, the second opening is arranged above the shaft of the second tub and communicated with the space for storing the particles.

Furthermore, the second opening is arranged at the top of the vertical center line of the second tub.

Furthermore, the second opening is a groove-shaped opening.

Furthermore, at least one first scraper blade projecting outwards is arranged on the outer wall of the first tub.

Furthermore, at least one second scraper blade projecting inwards is arranged on the inner wall of the third tub.

Furthermore, the axial lines of the first tub, the second tub, the third tub and the fourth tub are identical.

Furthermore, the first tub and the third tub are respectively driven to rotate by a driving device, and the second tub and the fourth tub are fixed.

A washing method of the roller washing machine comprises the following steps:

Step I: Adding a proper amount of water, washing agent and clothes to be washed into the first tub of the washing machine, rotating the third tub and putting the particles into the second tub;

Step II: Driving the first tub to rotate for washing the clothes;

Step III: After washing, driving the first tub to rotate at a high speed to allow the particles to enter the storing space between the second tub and the third tub for dewatering of the clothes and separating and recycling the particles.

Furthermore, after the washing process, it also comprises a rinsing step of clothes, specifically, adding clean water again for rinsing the clothes, and then dewatering again.

Furthermore, after the washing process, it also comprises the dewatering step of the particles; specifically, driving the third tub to rotate at a high speed for dewatering of the particles.

Furthermore, during the dewatering process of the particles, the third tub rotates at a speed of 100-1000 rpm.

Furthermore, during the process of feeding the particles in step I, the third tub rotates at a speed of 100-200 rpm.

Furthermore, during the process of dewatering of clothes and separating and recycling the particles in step III, the first tub rotates at a speed of 150-1000 rpm.

Furthermore, in step II, the third tub stops rotating during washing and the particles only circulate between the first tub and the second tub.

In summary, the present invention provides a roller washing machine and the washing method thereof, integrating such functions as clothes washing, separation of clothes from the particles, recycling and storage of the particles, dewatering of the particles together. Thus the friction-induced damages of particles with scraper blades are reduced during washing, and the service life of particles is prolonged. Besides, with the rotating of the first inner tub along with the scraper blades installed on the outer wall of the first inner tub, the present invention realizes a 100% put-in and recycling of the particles and reduces the noise generated in the separation of particles from clothes.

In the present invention, a storing space for storing particles is arranged in the space between the second tub and the third tub, which can prevent particles from blocking the water outlet at the bottom of the fourth tub during drainage. Meanwhile, during dewatering of the particles, the third tub can be directly driven for high-speed revolution to dewater the particles, saving the process of put-in and recycling of particles, thus simplifying the washing procedures and shortening washing time.

BRIEF DESCRIPTION OF THE DRAWINGS

As shown in FIG. 1-6, shell 1, first tub 2, second tub 3, third tub 4, fourth tub 5, clothes 6, particles 7, storing space 8, lifting block 9, first scraper blade 10, second scraper blade 11, second opening 12, and third opening 13

EMBODIMENTS

Figure 1:
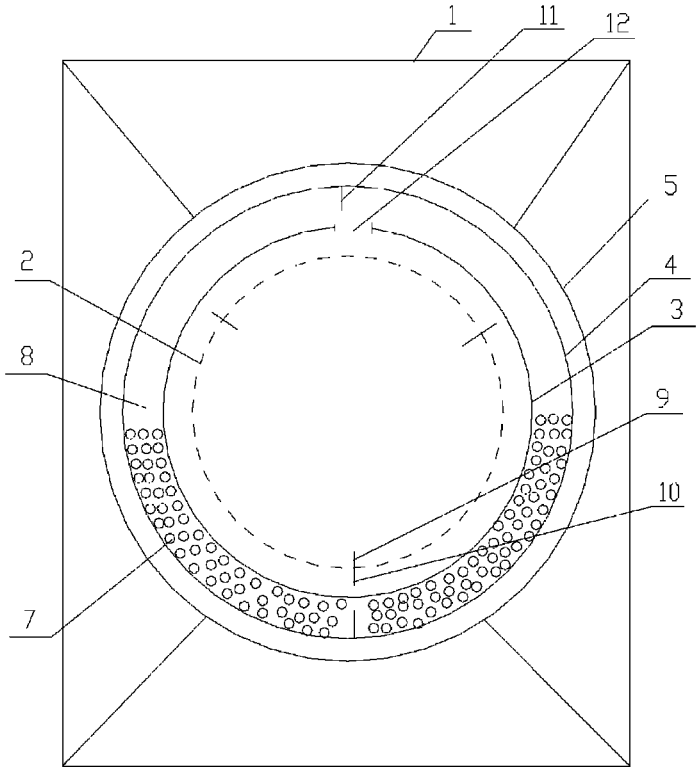
FIG. 1 is a structure diagram of the present invention.

By referring to the drawings and preferred embodiments, the present invention is further described hereinbelow:

As shown in FIG. 1, a roller washing machine comprises a shell 1, wherein, four layers of mutually sleeved washing tub and water containing tub are arranged in the shell 1, i.e., a first tub 2, a second tub 3, a third tub 4, and a fourth tub 5. The first tub 2, the second tub 3, the third tub 4, and the fourth tub 5 are arranged from inside to outside sequentially. Furthermore, the axial lines of the first tub 2, the second tub 3, the third tub 4 and the fourth tub 5 are identical as the same line.

Wherein, the second tub 3 and the fourth tub 5 are fixed, while the first tub 2 and the third tub 4 can be driven to rotate separately by a driving device. The first tub 2 and the third tub 4 can be driven by different motors (not shown in the figure), which are uniformly controlled by a control unit of the washing machine, or driven by a motor and a clutch. The first tub 2 and the third tub 4 may also rotate simultaneously or separately. Clothes 6 to be washed are put in the first tub 2 during washing and rinsing.

The fourth tub 5 is of a closed structure and mainly used as a water containing tub. A water inlet (not shown in the figure) allowing the inflowing of water during washing and rinsing is arranged on the fourth tub 5 as the outermost layer; a water outlet (not shown in the figure) for drainage after dewatering is arranged at the bottom of the fourth tub 5.

The space between the second tub 3 and the third tub 4 is used as a storing space 8 for particles 7. The weight ratio of the particles 7 to clothes 6 is generally 1:3. When there is a higher demand on washing effect, more particles 7 are needed. The more particles can be stored, when the whole storing space 8 between the second tub 3 and the third tub 4 is utilized. In washing process, if the particles 7 aren't needed, all the particles 7 are stored in the storing space 8. The particles stored in the storing space are generally deposited at the lower part of the storing space 8 due to the action of gravity. Preferably, particles 7 are made from porous polymer materials to raise their adsorption capacity and reach a better washing effect. Besides, storing the particles 7 in the space between the second tub 3 and the third tub 4 can prevent the particles 7 from blocking the water outlet at the bottom of the fourth tub 5.

Figure 2:
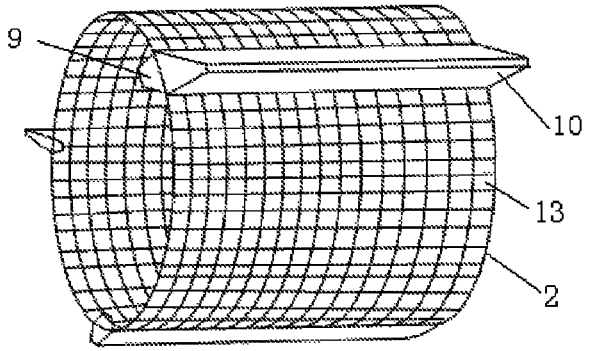
FIG. 2 is a structure diagram of the first tub of the present invention.

As shown in FIG. 2, at least one lifting block 9 projecting inward is arranged on the inner wall of the first tub 2. During washing, clothes 6 are continuously lifted and dropped in the first tub 2 under the effect of the lifting block 9 to reach the washing effect. The number of the lifting blocks 9 may be 1-3, and preferably, three lifting blocks 9 are arranged circumferentially and uniformly along the first tub 2 in the embodiment.

To feed and recycle the particles 7, at least one first scraper blade 10 projecting outward is arranged at the outer wall of the first tub 2 in the embodiment. The first scraper blade 10 is used to push the particles 7 in the second tub 3. The number of the first scraper blades 10 may be 1-3; preferably, three first scraper blades 10 are arranged circumferentially and uniformly along the first tub 2 in the embodiment. Radial height of the first scraper blade 10 is slightly shorter than the distance from the outer wall of the first tub 2 to the inner wall of the second tub 3, so that the first scraper blade 10 avoids scratching the inner wall of the second tub 3 when the first tub 2 rotates. Axial length of the first scraper blade 10 is roughly equal to that of the first tub 3 and the second tub 3.

As shown in FIG. 1, in the embodiment, at least one second scraper blade 11 projecting inward is arranged on the inner wall of the third tub 4, likewise, the second scraper blade 11 is used to push the particles 7 in the third tub 4. Thus it is convenient to feed and recycle the particles 7. Two second scraper blades 11 are preferably employed and arranged circumferentially and symmetrically along the third tub 4. Radial height of the second scraper blade 11 is slightly shorter than the distance from the inner wall of the third tub 4 to the outer wall of the second tub 3, so that the second scraper blade 11 avoids scratching the outer wall of the second tub 3 when the third tub 4 rotates. Axial length of the second scraper blade 11 is roughly equal to that of the third tub 4 and that of the second tub 3.

As shown in FIG. 2, a plurality of third openings 13 for allowing the particles 7 to pass through are uniformly arranged on the wall of the first tub 2. The particles 7 firstly enter in the second tub 3. During washing, the particles 7 pass through the third openings 13 and get in the first tub 2 to fully mix with the clothes 6 for washing. The third openings 13 may be circular, rectangular or polygonal in shape. The first tub 2 is a net structure of the third openings 13 formed by intersecting warps and wefts. Moreover, the dimension of the third openings 13 are much larger than the diameter of the particles 7, so that the particles 7 and washing water can get in and out of the first tub 2 easily.

A plurality of first openings (not shown in the figure) is uniformly arranged on the wall of the third tub 4 for dewatering. Similarly, the wall of the second tub 3 is also uniformly provided with a plurality of first openings (not shown in the figure) for dewatering. During dewatering of the clothes 6 and particles 7, washing water flows into the fourth tub 5 through the first openings on the walls of the second tub 3 and the third tub 4, and then is discharged from the water outlet at the bottom of the fourth tub 5 During washing, the washing water flows into the first tub 2 through the third tub 4, the second tub 3 and the first tub 2 successively to be fully mixed with the clothes 6. To prevent the particles 7 from leaking through the first openings on the walls of the second tub 3 and the third tub 4, the diameters of the first openings on the walls of the second tub 3 and the third tub 4 shall be smaller than the smallest diameter of the particles 7. Generally, the diameters of the particles 7 are from 2 mm to 4 mm, so the diameters of first openings on the walls of the second tub 3 and the third tub 4 shall all be smaller than 2 mm. In the embodiment, the diameters of the first openings are preferably from 1 m to 1.5 mm. Thus can ensure smooth inflow and outflow of washing water and avoid leakage of the particles 7 as well.

As shown in FIGS. 3-6, a second opening 12 for feeding and recycling the particles 7 is arranged on the wall of the second tub 3. The second opening 12 is connected to the storing space 8. To simplify the structure of the washing machine, the second opening 12 is a normally open. To avoid the particles 7 from leaking out through the second opening during washing, the second opening 12 is arranged at the top of the center line perpendicular to the shaft of the second tub 3 and is preferably a groove-shaped opening.

When feeding the particles 7, the first tub 2 remains still, while the third tub 4 rotates counterclockwise at a medium-low speed. Then, the second scraper blade 11 on the inner wall of the third tub 4 would push the particles 7 into the second tub 3 through the second opening 12 at the top of the second tub 3, and put in all the particles 7 adhering to the outer wall of the second tub 3 in the second tub 3. Thus it is to achieve 100% automatic put-in of the particles 7.

During recycling the particles 7, the third tub 4 remains still, and the first tub 2 is driven to rotate at a high speed. The first scraper blade 10 push the particles 7 into the storing space 8 through the second opening 12 at the top of the second tub 3 to complete the recycling of the particles 7.

In this structural design, neither a separate storage box for the particles 7 nor a separate control device for controlling to open/close the second opening 12 for the put-in and recycling of the particles 7 is needed. It is very convenient to feed, recycle and store the particles 7, and achieves automatic 100% put-in and recycling of the particles 7. As the storing space 8 for storing the particles 7 is arranged at the space between the second tub 3 and the third tub 4, during dewatering, the particles 7 can be dewatered directly by driving the third tub 4 to rotate at a high speed rather than repeating the process of put-in and recycling of the particles 7. It not only simplifies washing procedures, but also shortens washing time, as well as improves the service time of the particles 7.

By referring to FIGS. 3-6, the washing method of the aforesaid roller washing machine is described in details hereinbelow.

Figure 3:
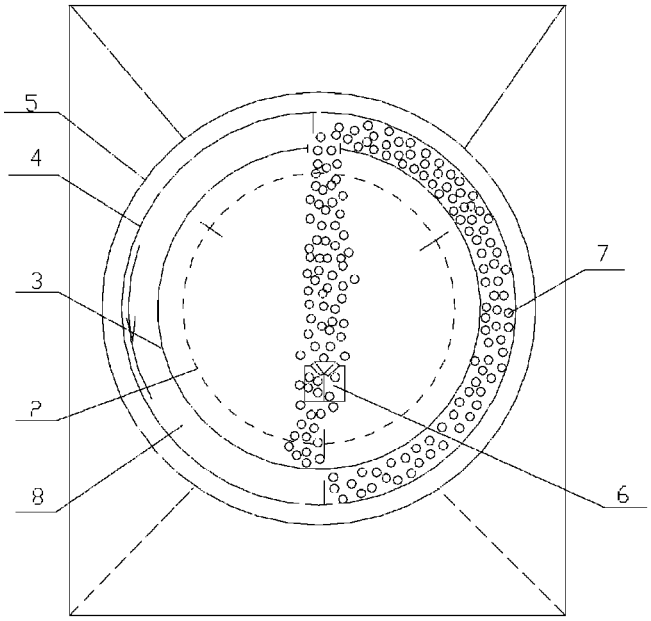
FIG. 3 is a schematic diagram of put-in process of the particles of the present invention.

This washing method comprises the following steps:

Step I: As shown in FIG. 3, like a normal roller washing machine, the clothes 6 to be washed are put in the first tub 2 of the washing machine, in the meantime, the water inlet on the upper of the fourth tub 5 is opened, via which the washing water mixed with the detergent flows into the fourth tub 5. Then, the water flows through the first opening on the third tub 4, the first opening on the second tub 2, and the third opening 13 on the first tub 2 to be fully mixed with the clothes 6 to be washed. In this process, only an appropriate amount of water and detergent is needed to ensure to soak the clothes 6 in water.

When feeding the particles 7 automatically, the third tub 4 is driven to rotate counterclockwise at a medium-low speed, and the first tub 2 remains still, so that the particles 7 from the storing space 8 are pushed into the second tub 3 through the second opening 12 at the top of the second tub 3 by the second scraper blade 11 on the third tub 4.

When feeding the particles 7, the third tub 4 rotates counterclockwise at a medium-low speed, wherein most preferably, the rotating speed is 100-200 rpm.

Figure 4:
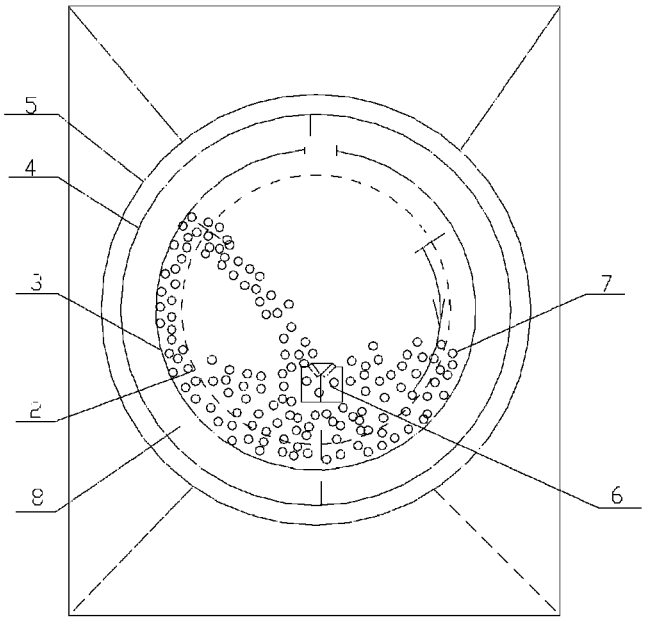
FIG. 4 is a schematic diagram of washing process of clothes of the present invention.

Step II: As shown in FIG. 4, after feeding all the particles 7, the first tub 2 is driven to rotate clockwise to wash the clothes 6 with the particles 7. During washing, the first tub 2 rotates at the speed of 40-60 rpm.

Figure 5:
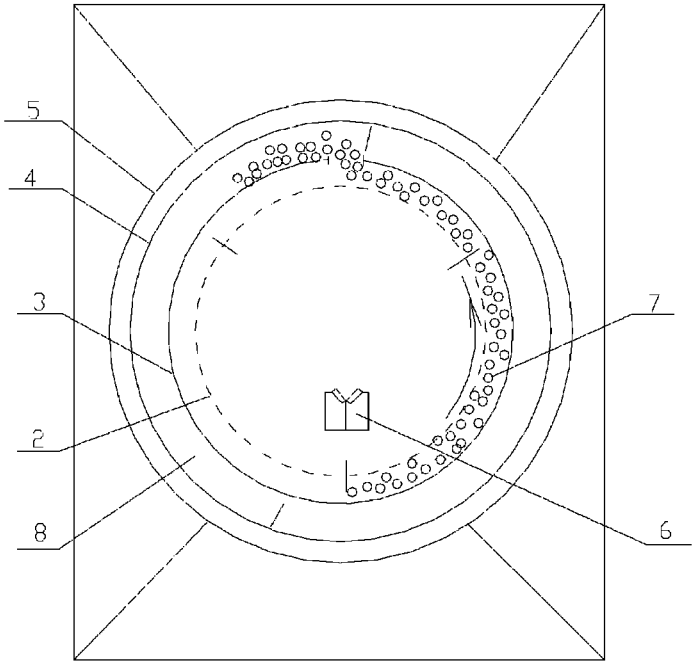
FIG. 5 is a schematic diagram of separation of particles from clothes and the recycling thereof described in the present invention.

Step III: As shown in FIG. 5, after washing, the first tub 2 is driven to rotate counterclockwise at a high speed, while the third tub 4 remains still. Under the effect of the first scraper blade 10, the particles 7 are pushed into the storing space 8 through the second opening 12. In this process, the clothes 6 are dewatered. The water flows in the fourth tub 5 through the third opening 13 on the first tub 2, the first opening on the second tub 3, and the first opening on the third tub 4, and then is discharged from the water outlet at the bottom of the fourth tub 5. Meanwhile, the particles 7 are separated from the clothes 6 and recycled.

In the process of dewatering clothes 6, separating and recycling particles, the first tub 2 is driven to rotate at a speed of 150-1000 rpm.

Step IV: During rinsing, appropriate amount of clean water is re-added to rinse clothes 6. In this process, the particles 7 no longer feed in the second tub 3, are all stored in the storing space 8. The third tub remains still; the first tub 2 is only driven to rotate clockwise to wash clothes 6.

After rinsing, the clothes 6 are dewatered again. The dewatering steps is the same as those in Step III. Finally, the whole washing process of the clothes ends.

Figure 6:
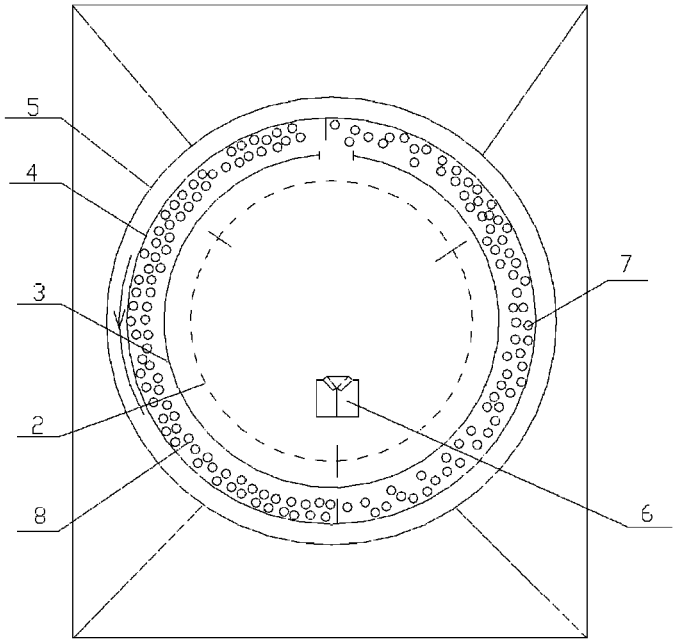
FIG. 6 is a schematic diagram of dewatering process of the particles of the present invention.

Step V: It is the automatic cleaning process of the particles 7. As shown in FIG. 6, the third tub 4 is driven to rotate counterclockwise at a high speed to dewater the particles 7. In this process, the third tub 4 is driven to rotate at a speed of 100-1000 rpm.

To sum up, combining the disclosed solutions of the attached drawing, similar technical solutions may be derived. Without departing from the content of the technical solution of the present invention, any simple amendment, equivalent change and modification to the aforesaid embodiments according to the technical essence of the present invention shall fall within the scope of the technical solution of the present invention.

The invention claimed is:

1. A roller washing machine, comprising a housing, four layers of mutually sleeved washing tubs and water containing tub, the four layers being all arranged in the housing, wherein, a first tub, a second tub, a third tub and a fourth tub are concentrically arranged, a water inlet is arranged on the fourth tub, particles are stored in a space between the second tub and the third tub, a plurality of first openings for dewatering are arranged on the walls of the second tub and of the third tub, a second opening for feeding and recycling the particles is arranged on the wall of the second tub, and the second tub is fixed.

2. The roller washing machine according to claim 1, wherein, the first tub is a net structure with third openings formed by intersecting warps and wefts for allowing the particles to pass through.

3. The roller washing machine according to claim 1, wherein, a diameter of each of the first openings is in a range from 1 mm to 1.5 mm.

4. The roller washing machine according to claim 1, wherein, the second opening is arranged above a shaft of the second tub and communicated with the space for storing the particles.

5. The roller washing machine according to claim 4, wherein, the second opening is arranged at the top of the vertical center line of the second tub.

6. The roller washing machine according to claim 4, wherein, the second opening is a groove-shaped opening.

7. The roller washing machine according to claim 1, wherein, at least one first scraper blade projecting outwards is arranged on the outer wall of the first tub.

8. The roller washing machine according to claim 1, wherein, at least one second scraper blade projecting inwards is arranged on the inner wall of the third tub.

9. The roller washing machine according to claim 1, wherein, the axial lines of the first tub, the second tub, the third tub and the fourth tub are identical.

10. The roller washing machine according to claim 1, wherein, the first tub and the third tub are respectively driven to rotate by a driving device, and the second tub and the fourth tub are fixed.

11. A washing method of a roller washing machine having a first tub, a second tub, a third tub and a fourth tub concentrically arranged, wherein the method comprises the following steps:

Step I: adding water, washing agent and clothes to be washed into the first tub of the washing machine, rotating the third tub and putting particles into the second tub;

Step II: driving the first tub to rotate for washing the clothes; and

Step III: after washing, driving the first tub to rotate at a speed sufficient to allow the particles to enter a storing space between the second tub and the third tub for dewatering of the clothes and separating and recycling of the particles.

12. The washing method according to claim 11, wherein, after the washing process, it also comprises a rinsing step of clothes, adding water again for rinsing the clothes and then dewatering again.

13. The washing method according to claim 11, wherein, after the washing process, it also comprises a dewatering step of the particles;

driving the third tub to rotate at a speed in a rage from 100 rpm to 1000rpm for dewatering of the particles.

14. The washing method according to claim 11, wherein, the third tub rotates at a speed of 100-200 rpm during the process of feeding the particles in step I.

15. The washing method according to claim 11, wherein, the first tub rotates at a speed of 150-1000 rpm during the process of dewatering of clothes and separating and recycling of the particles in step III.

16. The washing method according to claim 11, wherein, in step II, the third tub stops rotating during washing and the particles only circulate between the first tub and the second tub.

* * * * *